US005971864A

United States Patent [19]

Joshi et al.

[11] Patent Number: 5,971,864

[45] Date of Patent: Oct. 26, 1999

[54] THRUST POWERED GOLF CLUB

[76] Inventors: Ajay Joshi, 910 W. Meadowmere La., Austin, Tex. 78758; Kurt M. Marshek, 9701 Courtleigh Cir., Austin, Tex. 78759

[21] Appl. No.: 09/076,054

[22] Filed: May 11, 1998

[51] Int. Cl.[6] ..... A63B 69/36

[52] U.S. Cl. ..... 473/219; 473/226; 473/318

[58] Field of Search ..... 473/326, 207, 473/212, 215, 219, 226, 228, 409, 131, 206; 434/252

[56] References Cited

U.S. PATENT DOCUMENTS 3,037,775 6/1962 Busch ..... 473/326

5,632,693 5/1997 Painter ..... 473/318

*Primary Examiner*—Kien T. Nguyen

[57] ABSTRACT

A golf club for impelling a golf ball further with thrust force assist. Pressurized fluid from a fluid pump enters the club through the handle assembly and exits out through a fluid nozzle at the back of the club head. The club thus prepared is swung in the normal way. Due to the added thrust force, the club head velocity is greater than it would be without any assist, causing the ball to be impelled further down the fairway and/or teaching the golfer to swing faster. The club further includes a triggering mechanism to control the flow of fluid into the club.

8 Claims, 3 Drawing Sheets

THRUST POWERED GOLF CLUB

BACKGROUND OF INVENTION

1. Field of the Invention

The present invention relates to golf clubs. In particular, the present invention relates to a golf club that is used to increase the distance through which a golf ball is impelled by increasing the swinging speed of the golf club.

2. Description of the Prior Art

The game of golf utilizes clubs that are swung to contact a ball to provide the necessary energy to impel the ball down the fairway. Various types of clubs are used depending on the type of trajectory and distance desired. Many individuals are not able to reach their potential speed in swinging the club because of lack of strength or disability. Some required additional conditioning to achieve this potential.

In the past, many have tried unsuccessfully to solve this problem by (1) inventing clubs which generate an impelling force at the time of contact with the ball, none of which allow the golfer to improve his game; or (2) attempting to improve on the methods of swinging the club, without focusing on the speed of swinging the club.

An example for the first case would be U.S. Pat. No. 5,522,594 which discloses a golf club for impelling golf balls without swinging. The club uses expanding gas generated by an exploding charge to move a piston having an attached strike plate against a golf ball, impelling the ball down the fairway toward the green. The club obviously does not train golfers to swing a normal club.

An example for the second case would be U.S. Pat. No. 5,588,919 which discloses a golf swing training device actuated by the downswing of the golfer and comprising an arm angle detector which informs the golfer of the angle by transmitting a signal to the golfer's knee, waist and/or ankle. This invention and many others lack clear methodology to increase swing speed, which is the most effective parameter while attempting to maximize the distance traveled by the golf ball.

The present invention overcomes these deficiencies and provides effective training for golfers to improve their games.

SUMMARY OF THE INVENTION

The general object of the present invention is to provide a method of thrust to the golf club that is capable of providing a force to increase club speed so that the golf club can drive the golf ball farther down the fairway.

Another object of the invention is to create a golf club that will increase club swing speed and thus through 'overspeed' methods actually train the nervous system and thereby help train the golfer after a number of weeks of high-speed work take faster swings without any assistance. Research in other sports suggests that the user's swing speed will increase following 4 to 8 weeks of 'overspeed' work.

Another object of the invention is to create a thrust powered golf club that is similar to a conventional golf club in appearance and is lightweight.

Another object of the invention is to create a thrust powered golf club of sturdy construction capable of withstanding rough handling over a long period of time.

These and other objects of the invention will be apparent to those skilled in the art from the detailed description of the preferred embodiment of the invention below.

In general, the thrust powered golf club comprises a club head, a hollow shaft affixed to the club head at one end of the hollow shaft, and a handle assembly affixed to the other end of the hollow shaft. Attached to the handle assembly is a pump system which feeds fluid through the hollow shaft to the club head. The club head, which is either hollow or has an internal fluid passageway for the fluid, is provided with a fluid nozzle to allow for fluid to exit the club head in a direction opposite to that of the velocity of the club head during the swing.

The golf club further includes a flow valve for regulating the flow of fluid through the handle assembly and is operated by a person holding the golf club in a position ready for the downswing.

A person operating the thrust powered golf club may trigger the flow of fluid into the golf club, causing fluid to exit through the fluid nozzle at the back of the club head, and swing the golf club in a normal manner, to contact the golf ball, impelling the golf ball down the course.

BRIEF DESCRIPTION OF THE DRAWINGS

A preferred embodiment of the present invention is further described in connection with the accompanying drawings, in which.

DETAILED DESCRIPTION

Reference will now be made in detail to a presently preferred embodiment of the invention as illustrated in the accompanying drawings.

Figure 1:
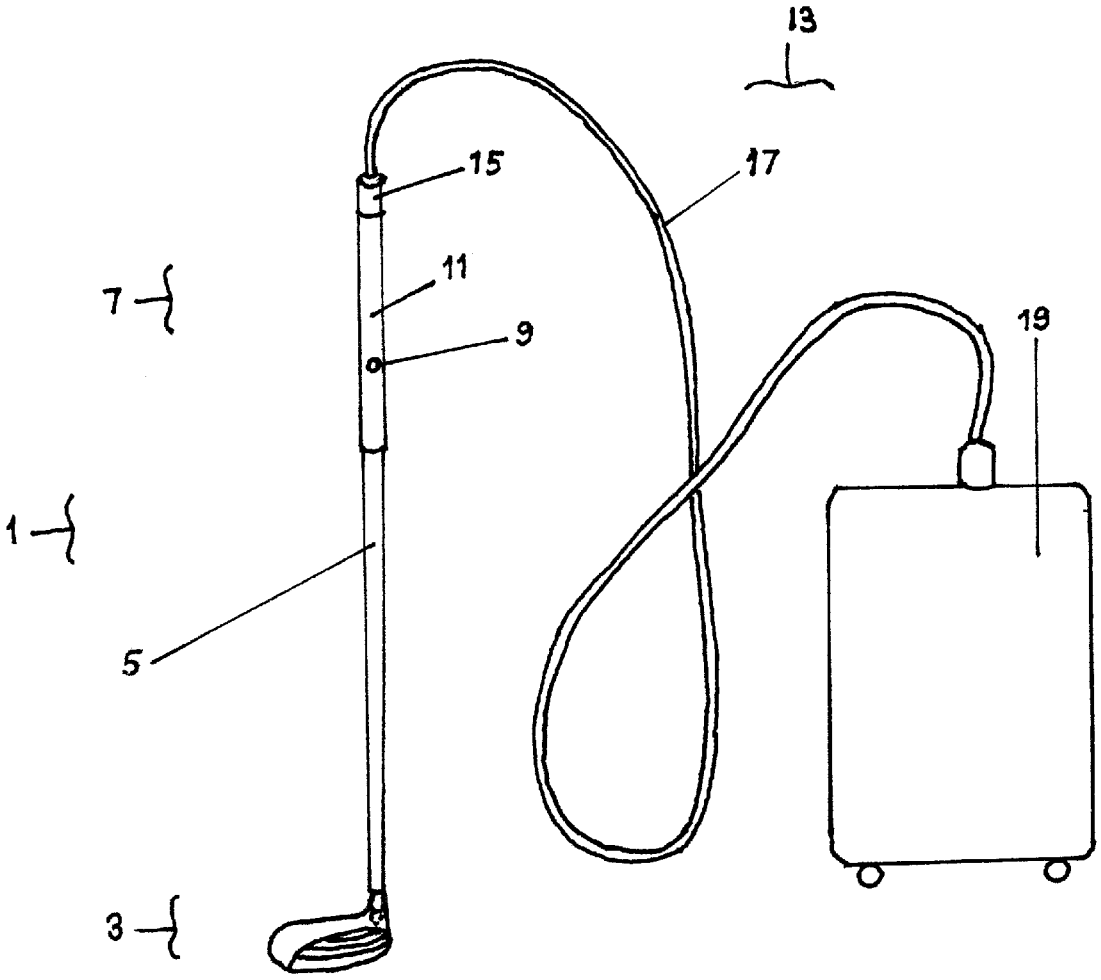
FIG. 1 shows a perspective overall view of the thrust powered golf club.

In FIG. 1 the Thrust Powered Golf Club 1 is shown having a club head 3, a hollow shaft 5 affixed to the club head 3 extending upwardly and slightly outwardly from club head 3, a handle assembly 7, affixed to the hollow shaft 5, including flow valve 9, and rubberized handle cover 11, and a pump system 13 affixed to the handle assembly 7 including connector 15, flexible fluid hose 17, and fluid pump 19.

The user holds the Thrust Powered Golf Club 1 by gripping, with the hands, the rubberized handle cover 11 of the handle assembly 7 in the same manner as a user holds a conventional golf club. The flexible fluid hose 17 routes from the handle assembly 7 at the connector 15 of the golf club 1 generally downward to the pump system 13 that is at ground level. The flexible fluid hose 17 is slack so that the hose 17 does not tighten when swinging the golf club 1. In the preferred embodiment, the pump system 13 is located on the ground at a distance from the user of the golf club 1 so as not to interfere with the user's swing.

In an alternative embodiment, the pump system 13 is attached to the user's back and the hose 17 is routed with slack to the connector 15.

The pump system 13 in the preferred embodiment is a commercially available gasoline engine powered water pump system 13 wherein water from a water source flows to the water pump 19 (e.g., water from a house water spigot (faucet) flows through a garden hose to the water pump 19). The pump 19 in the pump system 13 forces the water through the flexible fluid hose 17. The flexible hose 17 is connected at the connector 15 at the handle assembly 7 of the golf club 1. As mentioned, the flexible fluid hose 17 is sufficiently slack so that it loops or coils to the ground providing little if any noticeable resistance to the swinging of the golf club 1.

In another embodiment, the pump system 13 is a commercially available gasoline engine powered or electric motor powered air pump system 13 wherein air from the atmosphere flows to the air pump 19. The pump 19 in the pump system 13 forces the compressed air through the flexible fluid hose 17. The flexible hose 17 as stated being connected at the connector 15 at the handle assembly 7 of the golf club 1. As mentioned, the flexible fluid hose 17 is sufficiently slack so that it loops or coils to the ground providing little if any noticeable resistance to the swinging of the golf club 1.

Figure 2:
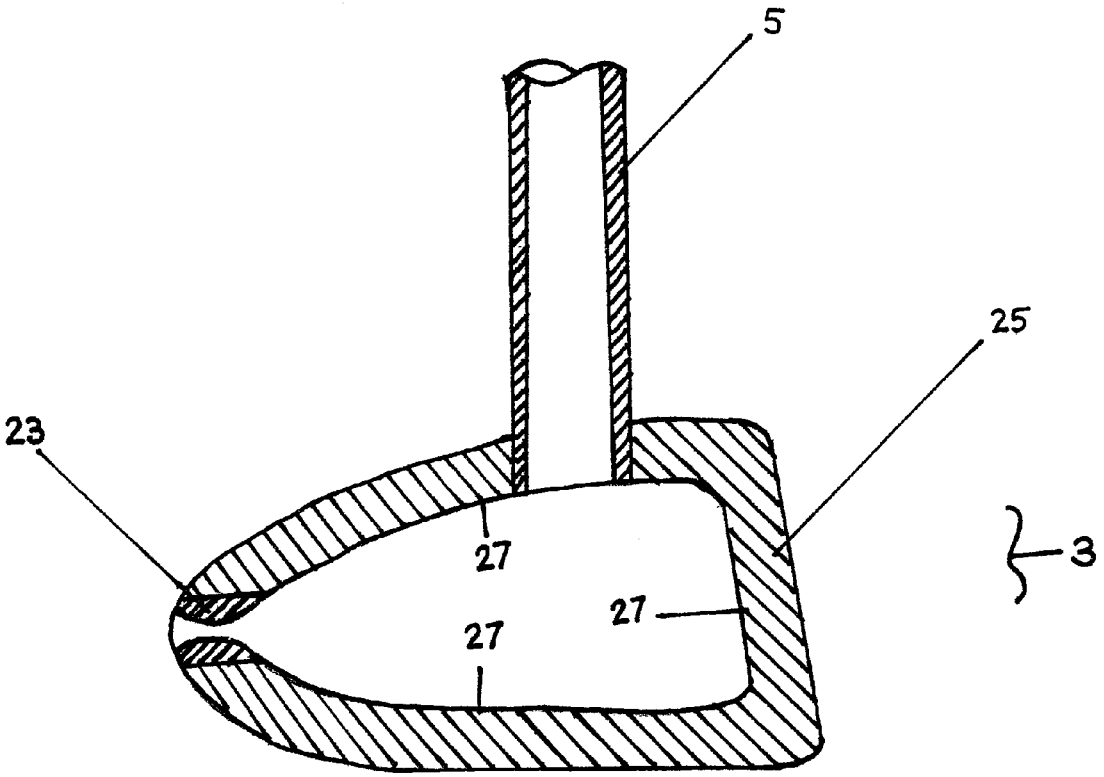
FIG. 2 shows a cross section of the preferred embodiment for the club head.

In the preferred embodiment, shown in FIG. 2, club head 3 affixed to hollow shaft 5 is hollow having inner surface 27, a fluid nozzle 23, and a club face 25. Club face 25 is directly opposite to fluid nozzle 23.

Figure 3:
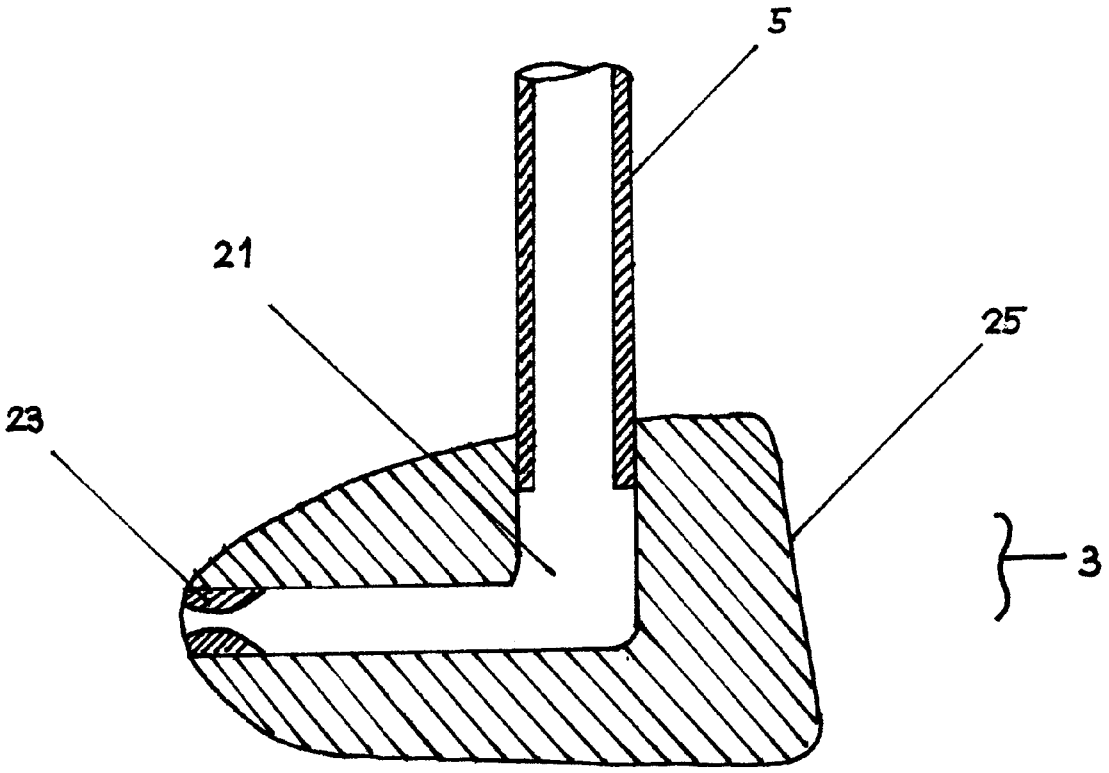
FIG. 3 shows a cross section of the alternate embodiment for the club head.

In an alternative embodiment, shown in FIG. 3, club head 3 affixed to hollow shaft 5 is not hollow having a fluid passageway 21, a fluid nozzle 23, and a club face 25. Club face 25 is directly opposite to fluid nozzle 23.

While the above description contains many specificities, the examples given should not be construed as limitations on the scope of the invention, but merely as exemplifications of preferred embodiments thereof. Additional advantages and modifications will readily occur to those skilled in the art. The invention in its broader aspects is therefore not limited to the specific details, representative apparatus and illustrative examples shown and described. Accordingly it should be apparent to those skilled in the art that variations and modifications are possible without departing from the spirit of the invention.

What is claimed is:

1. A thrust powered golf club comprising:

a golf club having a club head having a club face, a hollow shaft having a first end and a second end affixed to said club head at said first end of said hollow shaft, and a handle assembly affixed to said hollow shaft at said second end of said hollow shaft, said club head being hollow having an inner surface and having a fluid nozzle opposite to said club face, a pump system having a fluid pump, a flexible fluid hose having a first end and a second end affixed to said fluid pump at said first end of said flexible fluid hose, and a connector affixed to said flexible fluid hose at said second end of said flexible fluid hose, a connector means for joining said golf club to said pump system, whereby a person operating said golf club may swing said golf club in the normal manner, with fluid from said pump system entering said golf club through said handle assembly and exiting said club head at said fluid nozzle, urging said golf club to swing faster, impelling the golf ball farther down the golf course and/or teaching the golfer to swing faster.

2. The golf club of claim 1 wherein said handle assembly comprises a flow valve positioned on said handle assembly to control the flow of fluid.

3. The golf club of claim 1 wherein said pump system is a gasoline engine powered water pump system.

4. The golf club of claim 1 wherein said pump system is a gasoline engine or an electric motor powered air pump system.

5. A thrust powered golf club comprising:

a golf club having a club head having a club face, a hollow shaft having a first end and a second end affixed to said club head at said first end of said hollow shaft, and a handle assembly affixed to said hollow shaft at said second end of said hollow shaft, said club head not being hollow having a fluid passageway and having a fluid nozzle opposite to said club face, a pump system having a fluid pump, a flexible fluid hose having a first end and a second end affixed to said fluid pump at said first end of said flexible fluid hose, and a connector affixed to said flexible fluid hose at said second end of said flexible fluid hose, a connector means for joining said golf club to said pump system, whereby a person operating said golf club may swing said golf club in the normal manner, with fluid from said pump system entering said golf club through said handle assembly and exiting said club head at said fluid nozzle, urging said golf club to swing faster, impelling the golf ball farther down the golf course and/or teaching the golfer to swing faster.

6. The golf club of claim 5 wherein said handle assembly comprises a flow valve positioned on said handle assembly to control the flow of fluid.

7. The golf club of claim 5 wherein said pump system is a gasoline engine powered water pump system.

8. The golf club of claim 5 wherein said pump system is a gasoline engine or an electric motor powered air pump system.

* * * * *